US009330644B2

(12) United States Patent
Normand

(10) Patent No.: US 9,330,644 B2
(45) Date of Patent: May 3, 2016

(54) PERCUSSION INSTRUMENT

(71) Applicant: Gaudry Normand, Bonsecours (CA)

(72) Inventor: Gaudry Normand, Bonsecours (CA)

( * ) Notice: Subject to any disclaimer, the term of this patent is extended or adjusted under 35 U.S.C. 154(b) by 0 days.

(21) Appl. No.: 13/261,914

(22) PCT Filed: Dec. 10, 2012

(86) PCT No.: PCT/IB2012/002656
§ 371 (c)(1),
(2) Date: May 30, 2014

(87) PCT Pub. No.: WO2013/093588
PCT Pub. Date: Jun. 27, 2013

(65) Prior Publication Data

US 2015/0013523 A1 Jan. 15, 2015

(30) Foreign Application Priority Data

Dec. 11, 2011 (CA) ..... 2762576

(51) Int. Cl.
*G10D 13/08* (2006.01)

(52) U.S. Cl.
CPC ..... *G10D 13/08* (2013.01)

(58) Field of Classification Search
CPC ..... G10D 13/08; G10D 13/003
See application file for complete search history.

(56) References Cited

U.S. PATENT DOCUMENTS 1,173,784 A * 2/1916 Deagan ..... 84/403
1,200,370 A * 10/1916 Kohler ..... 84/403
1,210,950 A * 1/1917 Kohler ..... 84/403
1,380,960 A * 6/1921 Hmenia ..... 223/101
1,563,954 A * 12/1925 Barton ..... 223/101
1,575,960 A * 3/1926 Bartholomae ..... 84/403
1,885,843 A * 11/1932 Langer ..... 84/322
1,886,603 A * 11/1932 Strothotte ..... 84/403
2,207,672 A * 7/1940 Levey ..... 223/101
2,317,164 A * 4/1943 Zimmerman ..... 84/403
2,351,497 A * 6/1944 Fomeen ..... 84/170
D148,291 S * 1/1948 Emanuel ..... D17/22
2,458,193 A * 1/1949 Packheiser ..... 84/403
2,458,462 A * 1/1949 Zimmerman ..... 84/403
2,540,925 A * 2/1951 Zimmerman ..... 84/403
2,577,497 A * 12/1951 Zuckerman ..... 84/403
3,589,233 A * 6/1971 Rowe, Sr. ..... 84/402
4,239,134 A * 12/1980 Joy ..... 223/101
4,469,003 A * 9/1984 Phelps ..... 84/404

(Continued)

FOREIGN PATENT DOCUMENTS

GB 2165080 A * 4/1986

*Primary Examiner* — Robert W Horn

(74) *Attorney, Agent, or Firm* — Eric Fincham

(57) ABSTRACT

A pitched percussion idiophone instrument comprising first and second support members (12, 14) which interconnected, a plurality of hollow tubes (20), the tubes being parallel and having a pair of apertures (26, 28) towards each end (22, 24), first and second strings (34, 36) extending through the apertures (26, 28), pins (30) located on each of the first and second support members (12, 14) intermediate the hollow tubes (20) such that the strings (34, 36) are supported by pins (30), the arrangement being such that the hollow tubes (20) are suspended above said support members (12, 14) by the first and second strings (34, 36).

20 Claims, 5 Drawing Sheets

(56) References Cited

U.S. PATENT DOCUMENTS

| | | | | |
|---|---|---|---|---|
| 4,681,012 | A * | 7/1987 | Stelma et al. | 84/422.4 |
| 5,693,900 | A * | 12/1997 | Calato et al. | 84/422.4 |
| 5,977,465 | A * | 11/1999 | Piper | 84/422.4 |
| 6,305,926 | B1 * | 10/2001 | Ray | 425/458 |
| 6,726,068 | B2 * | 4/2004 | Miller | 223/101 |
| 6,734,349 | B1 * | 5/2004 | Adams | 84/322 |
| 7,439,434 | B1 * | 10/2008 | Cole et al. | 84/422.4 |
| 8,769,714 | B2 * | 7/2014 | Meltzner | 2/21 |
| 8,822,800 | B1 * | 9/2014 | Richmond | 84/422.4 |
| 2009/0178536 | A1 * | 7/2009 | Simons | G10D 13/08 84/402 |
| 2015/0013523 | A1 * | 1/2015 | Normand | 84/404 |

* cited by examiner

PERCUSSION INSTRUMENT

FIELD OF THE INVENTION

The present invention relates to a musical instrument and more particularly, relates to a pitched percussion idiophone that can be sub-classified both as a directly struck idiophone and as a friction idiophone. An example of a directly struck percussion idiophone is the xylophone. An example of a friction idiophone is the glass harmonica. Another example of a friction idiophone is the verrophone.

BACKGROUND OF THE INVENTION

Xylophones are believed to have originated around 2000 BC in China. Xylophones as we know them today first appeared in Eastern Asia around the ninth century and by the sixteenth century, they had reached Europe. They are known as a wooden percussion instrument. The use of the xylophone has evolved and they are used regularly in the percussion section of orchestras.

The glass harmonica is a type of musical instrument invented by Benjamin Franklin in 1761. It uses a series of glass bowls or goblets graduated in size to produce musical tones by means of friction. The phenomenon of rubbing a wet finger around the rim of a wine goblet to produce tones is documented back to Renaissance times. An instrument composed of glass vessels where one rubs the fingers around the rims dates back to the 1740's. Franklin's glass harmonica was reinvented by master glassblower and musician, Gerhard B. Finkenbeiner in 1984. Finkenbeiner Inc., of Waltham, Mass., continues to produce these instruments commercially and they are currently being used by a large number of contemporary musicians.

A verrophone is a musical instrument, invented in 1983 by Sascha Reckert, in which open-ended glass tubes are arranged in various sizes (usually in a chromatic scale, arranged from large to small, like the pipes of a pipe organ). The sound is made by rubbing one end of one or more of the glass tubes. The tubes are closer together so that chords can be played by rubbing more than one at the same time. The instrument carries more acoustical volume than the glass harmonica and other glass instruments and generally has a range from G3-C6.

SUMMARY OF THE INVENTION

It is an object of the present invention to provide a novel musical instrument of the pitched percussion idiophone type.

According to one aspect of the present invention, there is provided a percussion instrument comprising first and second support members, the first and second support members being interconnected, a plurality of hollow tubes, all of the tubes being parallel, all of the tubes having a pair of apertures at each end, first and second strings, the first string extending through the apertures at first ends of the tubes, the second string extending through the apertures at second ends of the tubes, and pins located on each of the first and second support members intermediate the hollow tubes, the first and second strings being supported by the pins, the arrangement being such that the hollow tubes are held above the support members by the first and second strings.

It will be understood that while reference is made to a pair of support members, this will include a frame which is unitary in nature such as a U-shaped member.

The pitched percussion idiophone instrument of the present invention, as stated above, includes at least one and preferably a plurality of hollow tubes which are designed to be struck by mallet or baton. The vibrations of the hollow tube produce the unique sound, due to the manner in which they are suspended under tension by the pins and the strings. Smaller versions of the invention can be composed of one tube only. Larger versions of the invention can be composed of many tubes with at least a two and a half octave range, for example from F3 to Bb5 and can be precisely tuned pitches. The hollow tube may be formed of many different materials and such materials are well known in the art.

For the present invention, a preferred material is quartz which is silicon dioxide or silica.

The strings used to suspend and interconnect the tubes also can be formed of different materials. Preferably, the strings are relatively thin and may be formed of a plastic string type arrangement.

The tubes are suspended above the support members by a series of pins, the pins being located on each side of the hollow tube at opposite ends. The pins may conveniently have apertures to receive the strings—in other words, the strings will pass through the two apertures in the end of a tube and then through the pin. The pins are preferably of a height so as to be located below the top of the tubes so as to not interfere with the playing of the instrument The pins are located on the frame members while the apertures within the hollow tube are arranged such that they are slightly interiorly of the support member. The arrangement is preferably such that the string as it enters the pin member and exits therefrom forms an angle of between 30° and 110°. More preferably, the strings form an angle of between 80° and 90°, which prevents the tubes from sliding towards the pins and allows the tubes to vibrate up and down, thus producing a unique sound. The apertures may also be located outwardly of the support member.

The instrument also preferably includes one or more devices for tensioning the strings to a desired level. Conveniently, one or more guitar keys can be utilized. While each string could have one guitar key which would serve to tension the strings, it is preferred that two such guitar keys be utilized, one at each end. Naturally, it will be understood that any device which tensions the string could be utilized.

The instrument may be played using a mallet(s) and striker(s) or alternatively, may be played using finger tappers. The finger tappers are designed to fit on one or more of the fingers of the player and have an exterior material similar to that of the strikers or mallets. Both the striker and finger tappers are preferably formed of a polymeric material. In a particularly preferred embodiment, the polymeric material is polyurethane. The hardness of the striker and/or finger tappers makes a substantial difference in the sound of the tubes. Preferably, the polymeric material will have a Shore hardness of between 80A and 90A and even more preferably, will have a Shore hardness of approximately 85A.

Alternatively, the instrument may be played using moistened palms and/or fingers.

The instrument can be played laid out flat on a table, vertically on a stand, or preferably it can be played while being held in the player's arms. This last position allows for freedom to move while playing the instrument.

As the instrument resonates for a substantial period of time, this can lead to interesting methods of playing. For example, the instrument may be moved while being played, or the player can move while playing the instrument to utilize the doppler effect.

The apertures at the end of the tube are preferably located to be at a distance of approximately 22.4% of the total length of the tube. This distance provides for the best harmonics.

BRIEF DESCRIPTION OF THE DRAWINGS

Having thus generally described the invention, reference will be made to the accompanying drawings illustrating an embodiment thereof, in which.

DETAILED DESCRIPTION OF THE INVENTION

Figure 1:
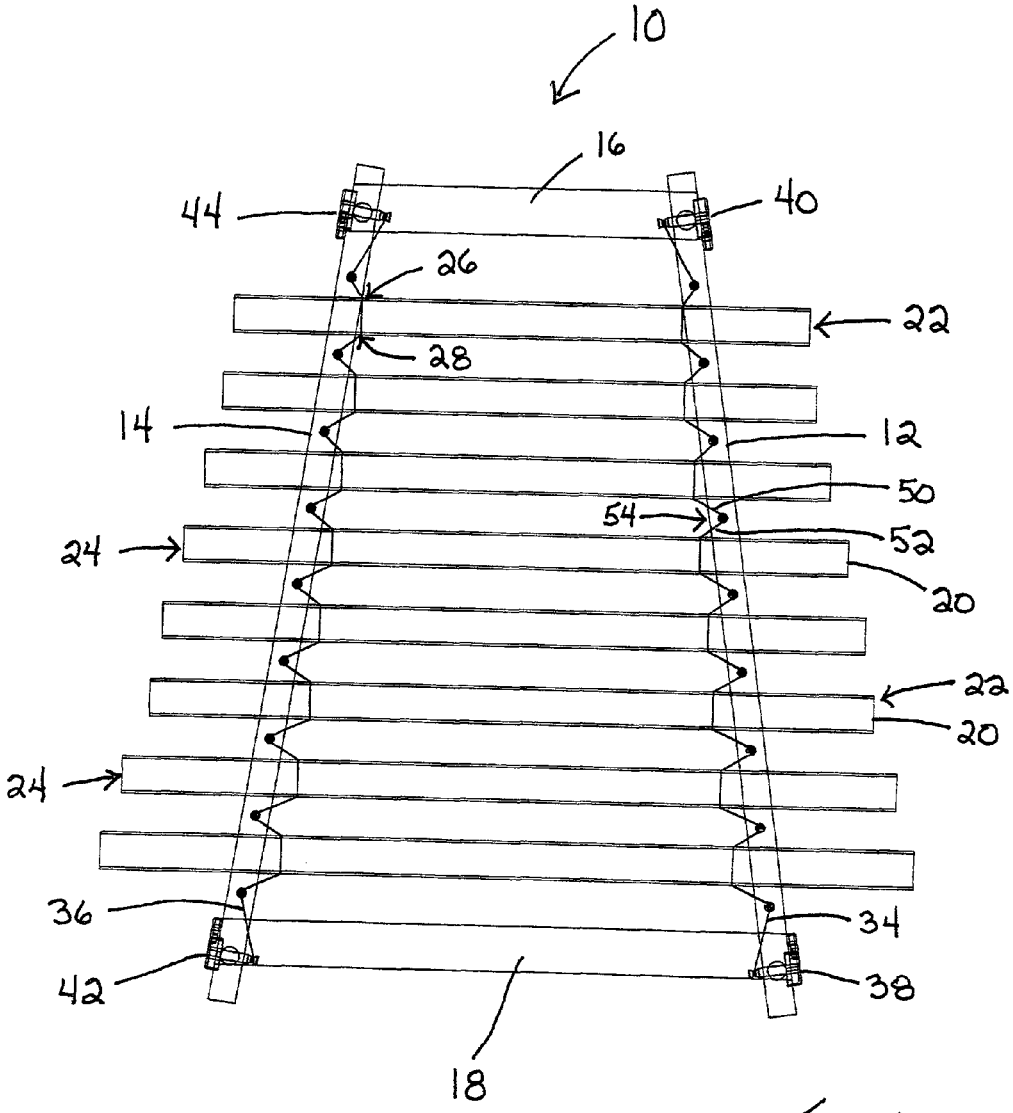
FIG. 1 is a top plan view of a percussion instrument according to an embodiment of the present invention.
Figure 2:
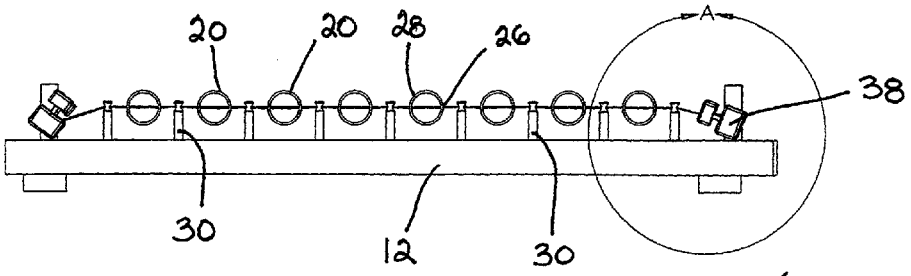
FIG. 2 is a side view thereof.
Figure 3:
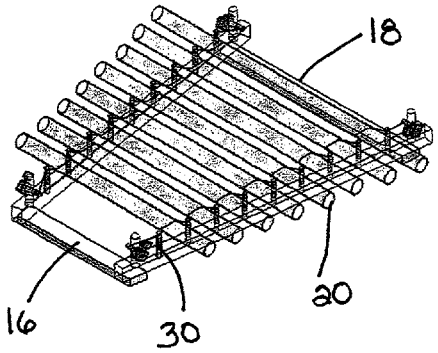
FIG. 3 is a perspective view thereof.

Referring to the drawings in greater detail and by reference characters thereto, there is illustrated a percussion instrument which is generally designated by reference numeral 10.

Percussion instrument 10 includes a first support member 12 and a second support member 14. Interconnecting first support member 10 and second support member 14 at one end thereof is a first transverse member 16. A second transverse member 18 interconnects first support member 12 and second support member 14 at an opposite end thereof. As will be seen, first support member 12 and second support member 14 are angled with respect to each other for reasons which will become apparent hereinbelow.

Percussion instrument 10 includes a plurality of hollow tubes 20 extending transversely of first support member 12 and second support member 14. Hollow tubes 20 are of varying lengths such that approximately the same amount of each tube extends outwardly of first support member 12 and second support member 14.

Each of hollow tubes 20 has a first end 22 and a second end 24. Formed within each hollow tube proximate the location of first support member 12 and second support member 14 is a first aperture 26 and a second aperture 28. First aperture 26 and second aperture 28 are preferably located diametrically opposed. It will also be noted that first aperture 26 and second aperture 28 are substantially diametrically opposed and are located slightly inwardly of first support member 12 and second support member 14.

A plurality of pins 30 are provided on first support member 12 and second support member 14. The arrangement is preferably such that there is one pin located intermediate each of the hollow tubes 20 along with a pin located proximate the ends of first support member 12 and second support member 14. Each pin 30 preferably has an aperture 32 located proximate an upper end thereof.

Percussion instrument 10 includes a first string 34 and a second string 36. First string 34 extends along first support member 12 and passes through apertures 32 in pins 30 and through first and second apertures 26 and 28 of hollow tubes 20. Second string 36 is arranged in an identical manner extending adjacent second support member 14.

Located adjacent each end of first support member 12 and second support member 14 are tensioning devices 38, 40, 42 and 44. Preferably, tensioning devices 38, 40, 42 and 44 are of a guitar key structure although it will be understood that any suitable tensioning devices may be utilized. Similarly, each string may only have one such tensioning device with the other end of the string being fixably secured.

Figure 4:
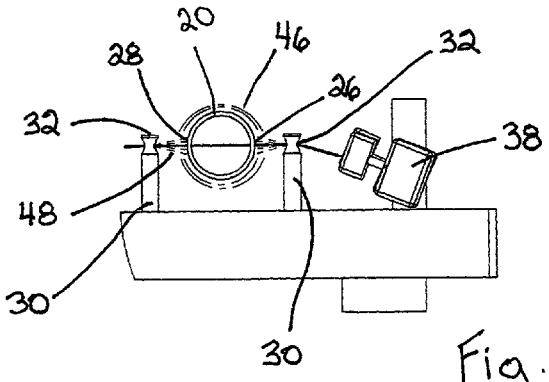
FIG. 4 is a detailed view of that portion designated by reference character A in FIG. 2.

As shown in FIG. 4, the arrangement is such that, when struck, a hollow tube 20 will vibrate as shown by vibration lines 46. Similarly, string 34 will also vibrate as shown by vibration lines 48. In essence, each tube can move slightly upwardly and downwardly according to the tension on first and second strings 34, 36.

A string segment 50 extending between a tube 20 and pin aperture 32 and a second string segment 52 likewise extending between tube 20 and pin aperture 32 preferably form an angle with respect to each other of between 80° and 90°.

Figure 5:
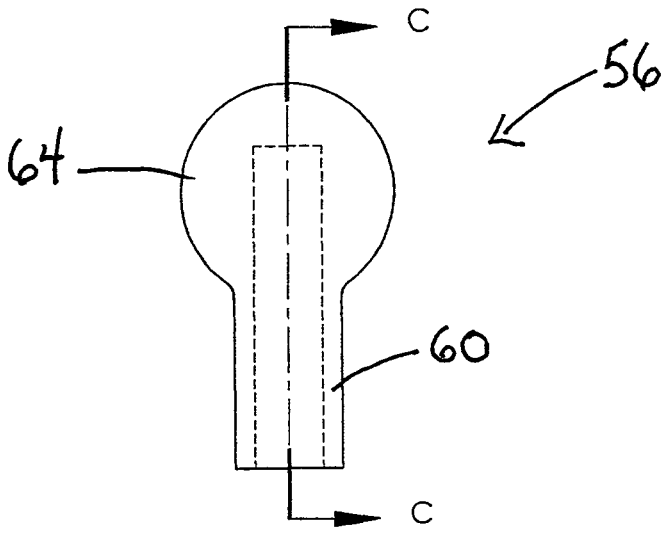
FIG. 5 is an elevational view of the end of a striker used for playing the instrument.
Figure 6:
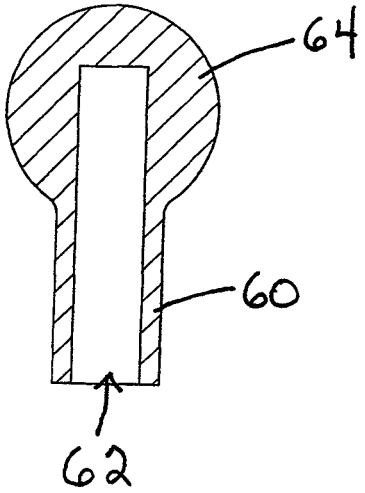
FIG. 6 is a cross sectional view thereof.
Figure 7:
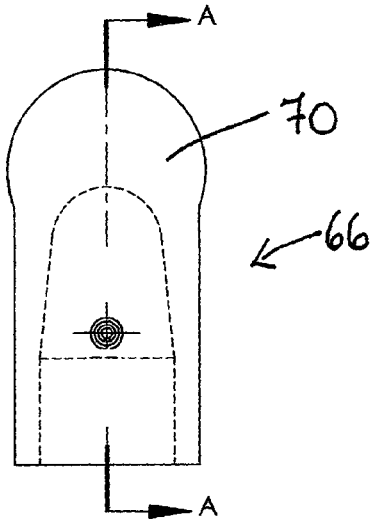
FIG. 7 is an elevational view of a finger tapper for playing the instrument.

Referring to FIGS. 5 and 6, there is illustrated the end of a striker, the end being generally designated by reference numeral 56. A shaft of a suitable material such as wood or acrylic is designed to fit within a recess 62 formed in striker end 56. As may be seen striker end 56 also includes a first cylindrical portion 60 and an enlarged end portion 64 which strikes the tubes.

Figure 8:
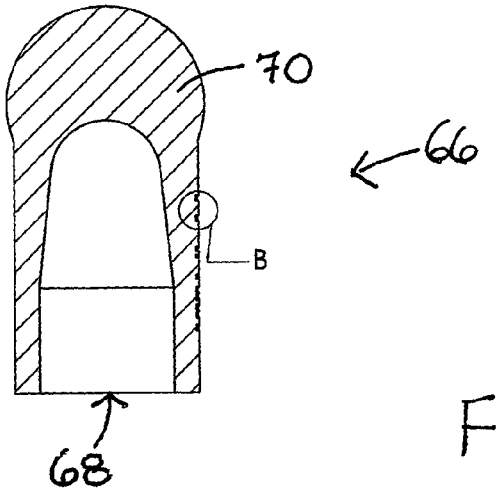
FIG. 8 is a sectional view thereof.
Figure 9:
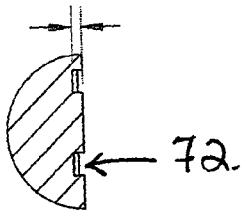
FIG. 9 is an enlarged portion of the side of the finger tapper indicated by reference numeral B.

As shown in FIGS. 8 and 9, there is provided a finger tapper generally designated by reference numeral 66. Finger tapper 66 includes a recess 68 to receive the finger of a user. There is also a somewhat enlarged end 70. As may be seen small recesses 72 may be formed in the lower portion of finger tapper 66. If desired, a similar arrangement could be utilized with striker end 56.

Both striker end 56 and finger tapper 66 may be formed of suitable materials, one of which is polyurethane having a Shore hardness typically between 80A and 90A. A preferred Shore hardness is approximately 85A.

Figure 10:
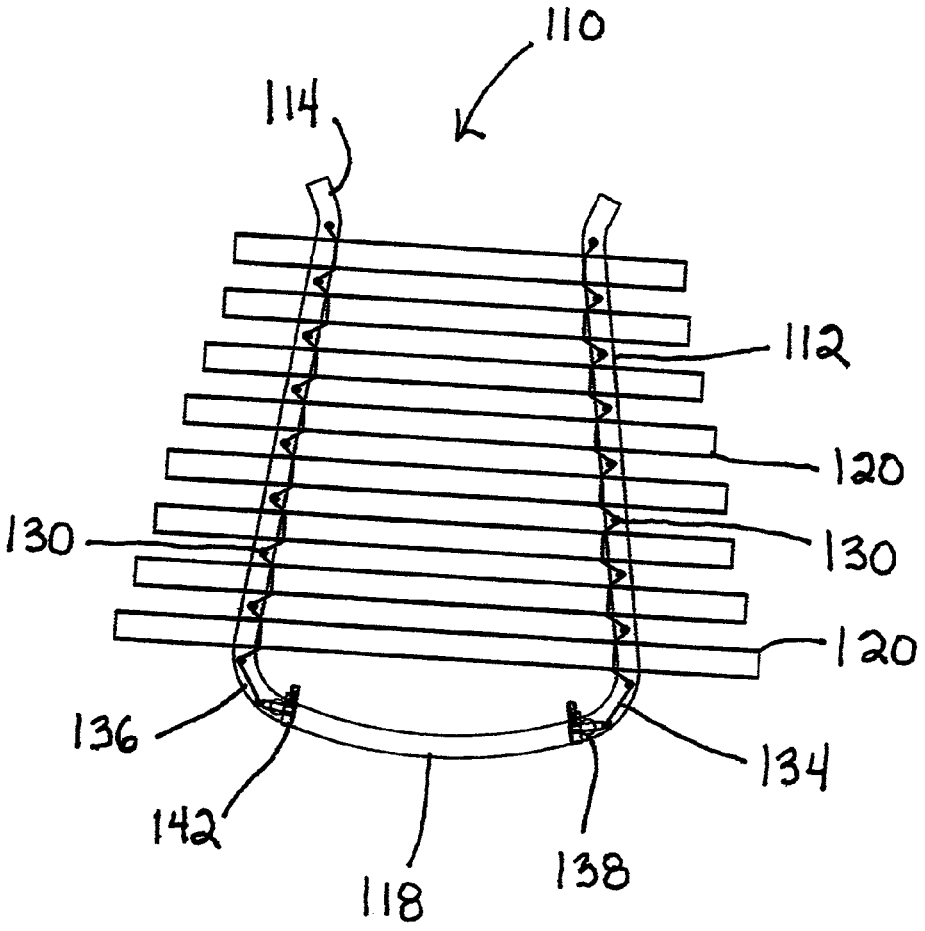
FIG. 10 is a perspective view of a further embodiment of a percussion instrument.

A further embodiment of the present invention is illustrated in FIG. 10 and reference will now be had thereto.

The embodiment of FIG. 10 is similar to the previously described embodiment and accordingly, reference numerals in the 100's will be utilized for like components.

Percussion instrument 110 includes a first support member 112 and a second support member 114. Interconnecting the two support members, is a transverse member 118. However, as can be seen in the drawing, transverse member 118 and support members 112, 114 are formed as a single U-shaped frame.

A plurality of hollow tubes 120 extend transversely of support members 112, 114. Each of hollow tubes 120 are supported by first string 134 and second string 136 which pass through apertures in the ends of hollow tubes 120 and through apertures in pins 130.

In this instance, there is only provided first and second guitar keys 138, 142.

As in the previously described embodiment, the arrangement is such that the hollow tubes 120 are suspended above the support members 112, 114 and are free to vibrate.

I claim:

1. A percussion instrument (10) comprising:

first and second support members (12, 14), said first and second support members being interconnected;

at least one elongated hollow tube (20) extending transversely with respect to said first and second support members, said hollow tube having a pair of apertures (26, 28) towards each end (22, 24);

first and second strings (34, 36), said first string (34) extending through said apertures (26, 28) at first ends of said tube, said second string (36) extending through said apertures (26, 28) at second ends of said tube; and supporting elements (30) located on each of said first and second support members (12, 14) on either side of said hollow tube (20) said first and second supporting elements extending upwardly, said first and second strings (34, 36) being supported by said supporting elements (30), said apertures and said supporting elements being transversely offset with respect to each other such that said first and second strings enter and leave a respective aperture in a diagonal direction, the arrangement being such that said hollow tube (20) is suspended above and spaced from said support members by said first and second strings (34, 36).

2. The percussion instrument of claim 1 including a plurality of parallel hollow tubes wherein said apertures (26, 28) in said tubes (20) are located inwardly of said support members (12, 14), said parallel hollow tubes extending beyond said first and second support members.

3. The percussion instrument of claim 2 further including at least one member (38) for tightening and loosening said strings (34, 36).

4. The percussion instrument of claim 3 wherein said member for tightening and loosening said strings comprises a guitar key (38).

5. The percussion instrument of claim 4 wherein each string has a separate guitar key for tightening and loosening a respective string.

6. The percussion instrument of claim 5 wherein each string (34, 36) has a guitar key (38, 40, 42, 44) located at each end thereof.

7. The percussion instrument of claim 1 wherein said apertures and said supporting elements are located such that the strings (34, 36) form an angle of between 30° and 110° at respective supporting elements (30).

8. The percussion instrument of claim 7 wherein said strings (34, 36) form an angle of between 80° and 90°.

9. The percussion instrument of claim 2 including first and second transverse members (16, 18) interconnecting said first and second support members (12, 14).

10. The percussion instrument of claim 2 further including first and second transverse members (16, 18) located at respective ends of said support members (12, 14) and connected thereto, said hollow tubes (20) being located intermediate said first and second transverse members (16, 18).

11. The percussion instrument of claim 2 wherein said tubes (20) are moveable towards and away from said support members (12, 14).

12. The percussion instrument of claim 2 wherein each of said supporting elements (30) has an aperture (32) therein, said strings passing through said apertures in said supporting elements.

13. The percussion instrument of claim 2 wherein said strings (34, 36) are formed of a plastic string.

14. The percussion instrument of claim 2 wherein said hollow tubes (20) are formed of a silicon dioxide material.

15. In combination, a percussion instrument (10) comprising:

first and second support members (12, 14), said first and second support members being interconnected;

at least one elongated hollow tube (20) extending transversely with respect to said first and second support members, said hollow tube having a pair of apertures (26, 28) towards each end (22, 24);

first and second strings (34, 36), said first string (34) extending through said apertures (26, 28) at first ends of said tube, said second string (36) extending through said apertures (26, 28) at second ends of said tubes;

supporting elements (30) located on each of said first and second support members (12, 14) on either side of said hollow tube (20) said first and second supporting elements extending upwardly, said first and second strings (34, 36) being supported by said supporting elements (30), said apertures and said supporting elements being transversely offset with respect to each other such that said first and second strings enter and leave a respective aperture in a diagonal direction, the arrangement being such that said hollow tube (20) is suspended above and spaced from said support members by said first and second strings (34, 36); and at least one device for striking said tubes.

16. The combination of claim 15 wherein said device is a hand held striker (56), said hand held striker (56) having an enlarged striker end (64).

17. The combination of claim 16 wherein said hand held striker (56) is formed of a polymeric material having a Shore hardness between 80A and 90A.

18. The combination of claim 17 wherein said material is polyurethane having a Shore hardness of approximately 85A.

19. The combination of claim 15 wherein said device for striking said tubes comprises at least one finger tapper (66), said finger tapper being formed of a polymeric material, said finger tapper having a recess (68) to receive a finger of a user.

20. A percussion instrument comprising:

first and second support members (12, 14), said first and second support members being interconnected;

hollow tubes (20), said hollow tubes having a pair of apertures (26, 28) towards each end (22, 24), said apertures being located either inwardly or outwardly of said support members;

first and second strings (34, 36), said first string (34) extending through said apertures (26, 28) at a first end of said tubes, said second string (36) extending through said apertures (26, 28) at a second end of said tubes (20);

supporting elements (30) located on each of said first and second support members (12, 14) on either side of said hollow tubes (20), said first and second strings (34, 36) being supported by said supporting elements (30), the arrangement being such that said hollow tubes are suspended above said support members by said first and second strings (34, 36); and at least one tension adjusting member (38) for increasing or decreasing the tension on said first and second strings (34, 36).

* * * * *